United States Patent [19]

Grotto

[11] Patent Number: 4,684,458

[45] Date of Patent: Aug. 4, 1987

[54] GRAIN CLEANING AUGER

[76] Inventor: La Von P. Grotto, Rte. 3, Box 62, Litchfield, Minn. 55355

[21] Appl. No.: 805,283

[22] Filed: Dec. 5, 1985

[51] Int. Cl.[4] ..... B07B 9/00

[52] U.S. Cl. ..... 209/31; 198/671; 209/35; 209/241; 209/278; 209/381; 209/399; 209/407

[58] Field of Search ..... 209/26, 34, 35, 241, 209/242, 261, 281, 283, 381, 399, 405–407, 487, 274–275, 282, 382, 401, 402, 412, 414, 31, 278, 276; 198/670, 671, 657, 661, 666

[56] References Cited

U.S. PATENT DOCUMENTS

| | | | |
|---|---|---|---|
| 331,967 | 12/1885 | Hawley | 209/261 |
| 821,496 | 5/1906 | Huffhines | 209/281 X |
| 988,095 | 3/1911 | Haugo | 209/317 |
| 1,005,380 | 10/1911 | Wear | 209/34 |
| 1,010,239 | 11/1911 | Cox | 209/35 |
| 1,031,832 | 7/1912 | Bohn | 209/262 X |
| 1,158,396 | 10/1915 | Walch | 209/283 X |
| 1,279,308 | 9/1918 | Emenegger | 209/35 |
| 1,781,472 | 11/1930 | Nagle | 209/283 X |
| 2,483,200 | 9/1949 | Haug | 209/270 X |
| 2,545,140 | 3/1951 | Escher | 198/666 |
| 2,706,046 | 4/1955 | Andrews | 209/283 |
| 2,718,967 | 9/1955 | Potter | 209/261 |
| 3,070,230 | 12/1962 | Peterson | 209/382 X |
| 3,251,467 | 5/1966 | Bakke | 209/283 X |
| 3,348,676 | 10/1967 | Karlsson et al. | 209/22 |
| 3,513,973 | 5/1970 | Grulke | 209/241 |
| 3,532,276 | 10/1970 | Dunn | 209/289 X |
| 3,727,759 | 4/1973 | Stevens | 209/283 |
| 3,928,188 | 12/1975 | Link et al. | 209/300 X |
| 4,177,900 | 12/1979 | Kluthe | 209/261 X |

*Primary Examiner*—Joseph J. Rolla
*Assistant Examiner*—Kevin P. Shaver
*Attorney, Agent, or Firm*—Merchant, Gould, Smith, Edell, Welter & Schmidt

[57] ABSTRACT

A grain cleaning attachment is disclosed for a grain auger. The attachment includes a cylindrical vibrating portion to surround the auger flighting after removal of a portion of the auger tube. The vibrating member is sized to provide a clearance between the walls of the member and the auger flighting to permit vibratory displacement of the member. Rubber sleeves connect the vibrating member ends to free ends of the auger tube. A vibration motor is carried by the vibrating member to affect vibration of the member. A tube support member is provided comprising a pair of rigid sleeves rigidly connected to the auger tube on both a downstream and upstream side of the vibrating member. Rigid braces connect the sleeves in axial alignment. A downstream sleeve has an opening to find therethrough in communication with an interior of the tube with a blower carried on the sleeve having an intake in communication with the opening. A bottom portion of the vibrating member is a sieve which separates out small foreign material from grain as grain is carried by the auger through the vibrating member. The foreign material which is too light to be properly separated migrates to a top surface of the grain as the vibrating member vibrates. This material is drawn off through the blower as the grain proceeds its transporation through the auger. Air current through the grain draws the light material out of the grain and through the blower.

13 Claims, 5 Drawing Figures

GRAIN CLEANING AUGER

BACKGROUND OF THE INVENTION

I. Field of the Invention

This invention relates to apparatus for cleaning grain of undesirable foreign material and more particularly to an auger which cleans grain while transporting grain through the auger.

II. Description of the Prior Art

When grain is harvested, it contains a variety of undesirable solid foreign material. Examples of such undesirable material include fines, weed seeds and other trash as well as very light foreign material such as hulls, chaff, insects and bees wings. It is desirable to clean grain of such foreign material in order to improve the quality of the grain product as well as result in less spoilage during storage of the grain and more efficient drying of the grain. The prior art is complete with many separate grain cleaning apparatus which are separate from augers used in grain harvesting operations to transport grain. An example of prior art which teaches a grain cleaning mechanism which acts simultaneous with grain transportation is U.S. Pat. No. 331,967 to Hawley dated Dec. 8, 1885. Hawley teaches a grain elevator which has a trough beneath the elevator. An opening is formed in the trough and covered with a wire screen through which fine seeds and other impurities may pass. U.S. Pat. No. 988,095 to Haugo dated Mar. 28, 1911, teaches a grain auger used in a grain separator. An arcuate screen or sieve member forms a trough for the auger to carry the grain being delivered by the auger. The sieve member functions to separate out small weeds from the grain being carried by the auger. The auger and sieve member are sized such that the auger fits closely against the upper surface of the sieve member so as to physically scrape grain from the sieve in order that the sieve will not become clogged. In both Hawley and Haugo the sieves and troughs are fixed.

Sieves such as taught by Hawley and Haugo permit passing of solid material and may be effective in partial separation of grain from heavier foreign material from the grain. However, grain includes very light foreign material such as insects and bees wings and chaff which, due to their extreme lightness, cannot be properly screened. When vibrated, such light material migrates to the top of the grain and does not fall through a screen. One way to separate light particles is to establish an air current which carries the light particles away from the grain. Examples of grain cleansing apparatus which generate air currents by means of blowers include U.S. Pat. No. 3,348,676 to Karlsson and U.S. Pat. No. 2,718,967 to Potter.

Notwithstanding the current status of the prior art, there is a continuous desire to improve grain cleansing apparatus to improve the quality of the grain cleansing. Also, there is a continuing search for apparatus which minimize the amount of processing necessary to transport and cleanse grain.

OBJECTS AND SUMMARY OF THE PRESENT INVENTION

It is an object of the present invention to provide an apparatus for cleansing grain while it is being transported through an auger. It is a further object of the present invention to provide an apparatus for cleansing transported grain which efficiently separates from the grain heavy material as well as light material.

According to the preferred embodiment of the present invention, there is provided a grain cleaning attachment for a grain auger. The attachment includes a housing which surrounds a portion of the auger flighting which has been exposed by removal of a portion of the auger tube. The housing has a lower portion which is a screen having mesh sized to pass undesirable solid material which is mixed with the grain but block passage of grain through the screen. The housing has an interior surface with the housing sized such that the interior surface is spaced from the auger flighting by a predetermined clearance. The housing is flexibly secured to the tubing. A vibrator or vibration motor is provided to vibrate the housing with the flexible mounting accommodating the vibration movement of the housing. A tubular frame is provided which joins the auger tubing on both sides of the housing. The frame carries a blower which has an intake in communication with the interior of the tubing on a downstream side of the housing. In operation, the auger draws grain through the tubing and the housing is vibrated such that grain within the housing is agitated on the surface of the screen with heavier foreign debris permitted to pass through the screen and with lighter foreign debris moving to the top of the grain. After the grain passes through the housing, the blower draws a suction on the interior of the tubing and draws the light material out of the tubing leaving the clean grain to continue transportation through the auger.

DESCRIPTION OF THE PREFERRED EMBODIMENT

Figure 1:
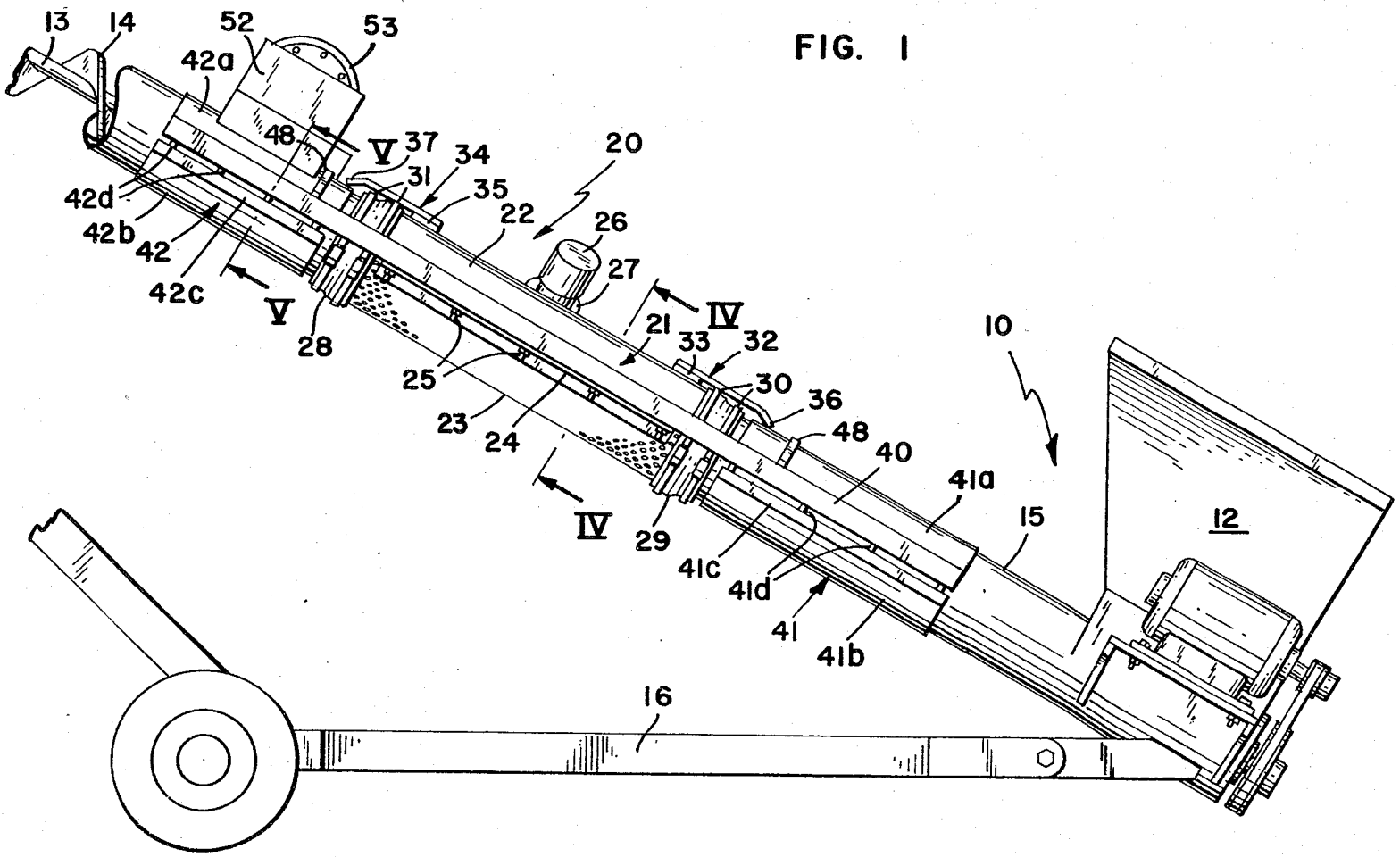
FIG. 1 is a view taken in elevation of a portion of an auger equipped with a grain cleaning attachment according to the present invention.
Figure 2:
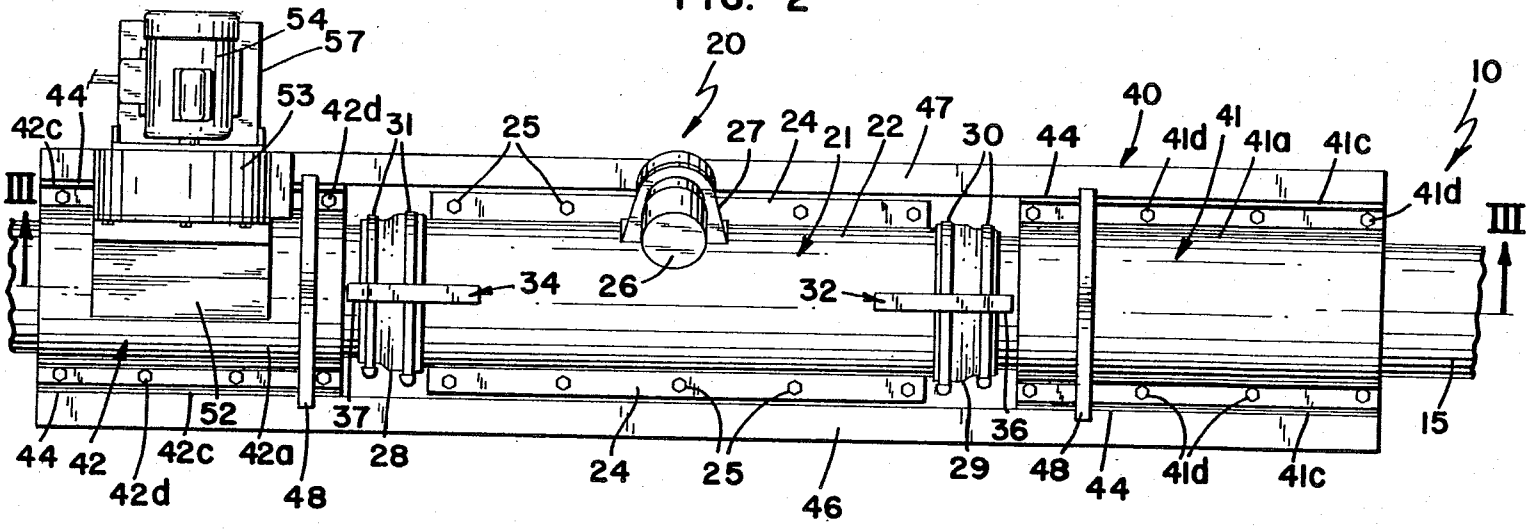
FIG. 2 is a top plan view of a grain cleaning attachment according to the present invention.

Referring to the drawings, a grain auger generally designated at 10 is shown for transporting grain. Shown most clearly in FIG. 1, the auger includes a first or upstream end having a grain intake 12. The auger includes an auger shaft 13 equipped with helical flighting 14 with the shaft and flighting secured for rotation about the shaft's axis. Surrounding the shaft flighting 14 is an auger tube 15. An auger support 16 supports the auger for transporting grain from the intake 12 to a desired higher elevation discharge or downstream end (not shown). For purposes of this discussion, the terms upstream and downstream are used with reference to the direction of grain flow when the auger is operating regardless of the elevation of a particular part of the auger 10.

Figure 4:
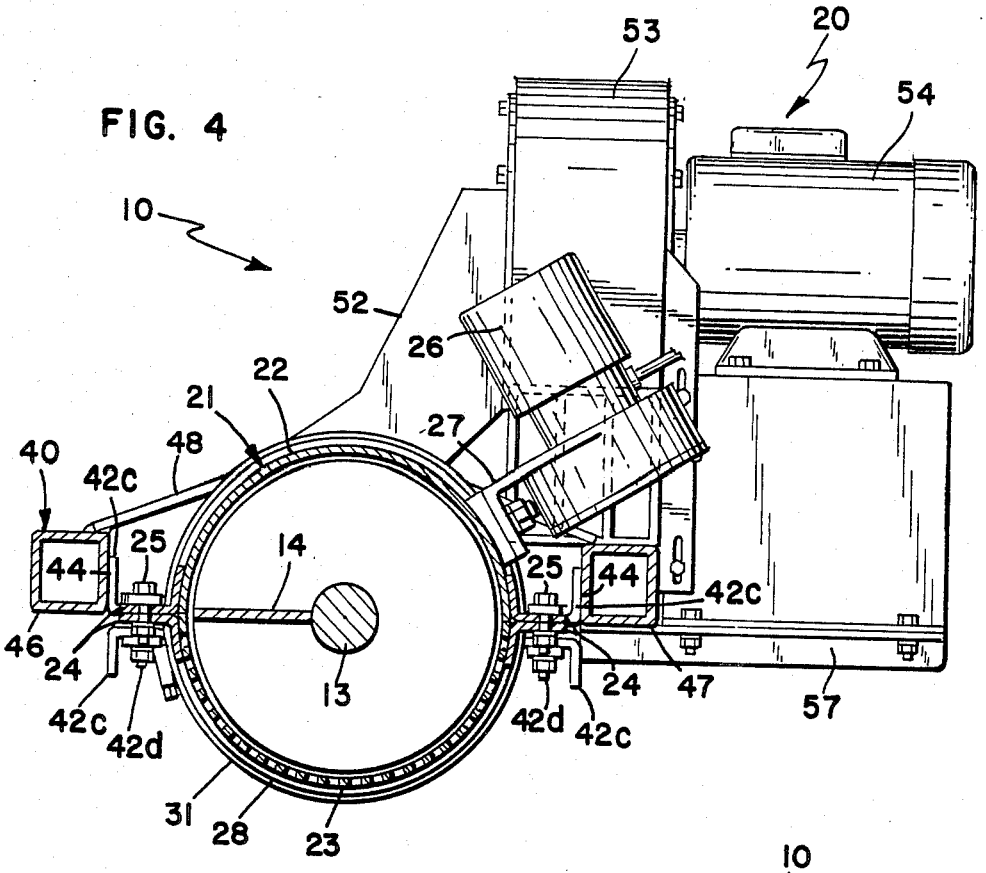
FIG. 4 is a cross sectional view of a grain cleaning attachment taken along line IV—IV of FIG. 1.
Figure 5:
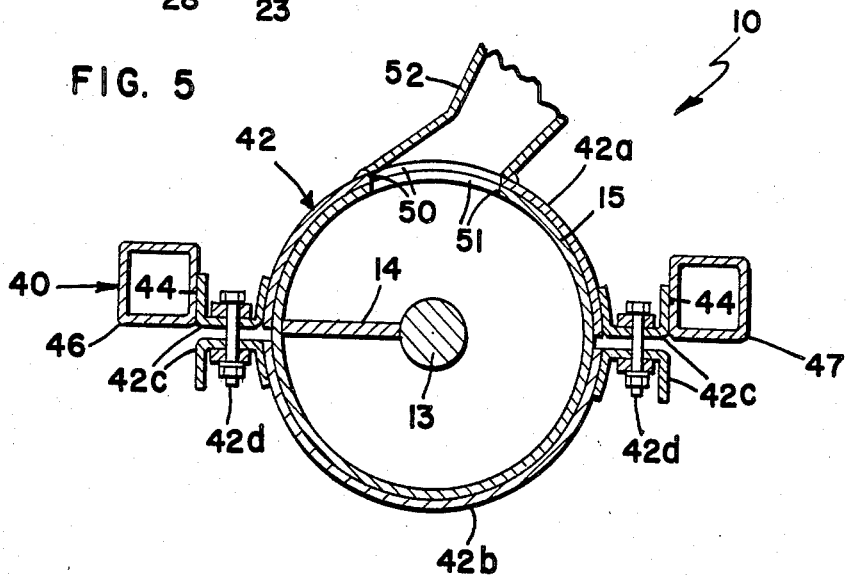
FIG. 5 is a cross sectional view of a grain cleaning attachment taken along line V—V of FIG. 1.

To clean grain while it is being transported through the auger 10, a grain cleaning attachment is shown generally at 20. The grain cleaning attachment 20 includes a cylindrical housing 21 which surrounds the auger flighting 14 along a portion of the auger flighting 14 which has been exposed due to removal of a portion of the auger tube 15 to accommodate the cleaning attachment. The housing 21 includes a solid semicylindrical upper portion 22 and a lower semicylindrical sieve portion 23. Both the upper and lower semicylindrical sections 22 and 23 are provided with outwardly extending axially aligned flanges 24 with opposing flanges of portion 22 and 23 mating when the portions are placed together to form a completed cylinder. Bolt and nut means 25 passing through the flanges 24 secure the upper portion 22 to the lower sieve portion 23. As shown most clearly in FIG. 4, the housing 21 is sized such that its inner cylindrical surface opposing the flighting 14 is spaced away from the flighting by a clearance. This is in contrast to the customary close tolerance between the flighting 14 and inner surface of the auger tube 15 as shown in FIG. 5. As described more fully hereafter, the clearance permits vibratory motion of the housing 21 about the flighting 14. Vibration means in the form of a vibration motor 26 is secured to the upper solid cylindrical portion 22 by means of a mounting bracket 27. Vibration motors such as motor 26 are commercially available items and may be such as Model No. SPR-80 manufactured by Vibco Inc., Wyoming, R.I.

The housing 21 is flexibly secured to the auger tube 15 by means of a pair of rubber sleeves 28 and 29. Sleeve 29 connects the housing 21 to a lower or upstream portion of the tube 15 as best shown in FIG. 1. The sleeve 29 is fastened to both the tube 15 and the housing 21 by means of fastening straps 30. Likewise, sleeve 28 is provided connecting the housing 21 to an upper or downstream portion of the tube 15 with the sleeve 28 fastened to both the tube 15 and the housing 21 by means of fastening straps 31.

Figure 3:
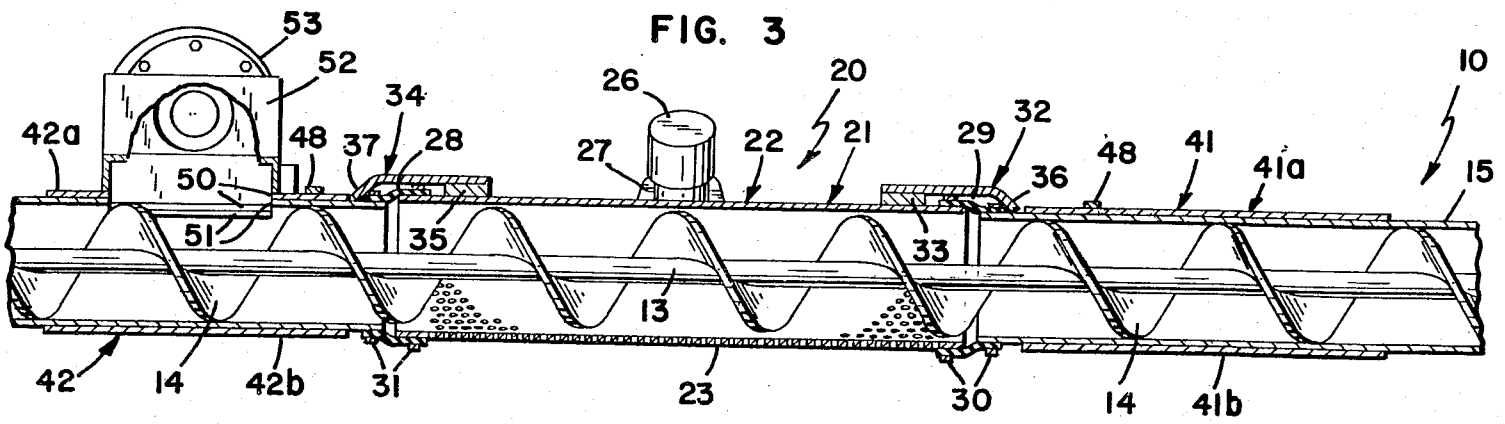
FIG. 3 is a view of a grain cleaning attachment taken along line III—III of FIG. 2.

As best shown in FIG. 3, the housing 21 is provided with an axial dimension less than an axial dimension of the auger tube removed to expose the flighting 14. The sleeves 29 and 28 connect the housing to the remaining tube portions and cover gaps between the housing 21 and the tube 15. The flexible sleeves 28 and 29 will permit relative axial and radial motion between the housing 21 and the tube 15.

To support the housing 21 and prevent the housing from falling onto the flightings 14, a pair of stops are provided including an upstream stop 32 and a downstream stop 34. The stops comprise a piece of rigid metal which are welded to intermediate spacer blocks 33 and 35 which are in turn welded to the top of the solid semicylindrical portion 22 of the housing 21. Elevated by spacer blocks 33 and 35, the stops 32 and 34 extend axially away from the housing above the sleeves 29 and 28 to free ends 36 and 37 which are bent radially inwardly to abut auger tube 15.

A tubular frame shown generally at 40 is provided for joining the upstream and downstream portions of tube 15 and provides structural integrity to the auger to account for the removal of the auger tube portion removed to accommodate the housing 21. The tubular frame 40 includes an upstream sleeve 41 which consists of an upper semicylindrical portion **41*a* and a lower semicylindrical portion 41*b*. Upper portion 41*a* and lower portion 41*b* are both provided with outwardly projecting axially aligned flanges 41*c* which are joined by means of bolt and nut means 41*d*. The frame member 40 also includes a downstream sleeve member 42 which includes an upper semicylindrical portion 42*a* and a lower semicylindrical portion 42*b* which are provided with outwardly projecting flanges 42*c* which receive nut and bolt means 42*d* for joining the upper portion 42*a* to the lower portion 42*b*. As shown most clearly in FIG. 5, the upper and lower portions of the sleeve members 41 and 42 are sized not to present complete cylinders when they are joined enclosing the auger tube 15. With this arrangement, the nut and bolt means 42*d* and 41*d* can be tightened to draw the upper and lower portions of the sleeves 41 and 42 together and make a snug and fast attachment of the sleeves 41 and 42 to the auger tube 15**.

When the sleeves 41 and 42 are fastened to the auger tube 15, the flanges **41*c* and 42*c* on the upper portions 41*a* and 42*a* of the sleeves present axially aligned vertical welding surfaces 44 on both sides of the sleeves. A first rigid brace 46 of tubular structural steel is provided and welded to the axially aligned surfaces 44 of the upstream sleeve 41 and the downstream sleeve 42 on a side of the sleeves. Likewise, on an opposite side of the sleeves, a second rigid brace 47 of tubular structural steel is provided welded to the surfaces 44 of the upstream sleeve 41 and the downstream sleeve 42. For additional structural stability, metal straps 48 are provided extending from the first brace 46 to the second brace 47 and crossing over the tops of the upstream sleeve 41 and the downstream sleeve 42. The braces 48 are securely welded to each of the braces 46 and 47 and to the tops of the sleeves 41 and 42. As shown in FIGS. 4 and 5, the flanges of the upstream sleeve 41 and the downstream sleeve 42 are sized such that they project radially outwardly from the sleeves a distance sufficient for the braces 46 and 47 to pass the housing 21 without contacting the housing 21 and to provide a clearance between the braces 46 and 47 and the housing 21 to permit vibratory motion of the housing 21. Also, the sleeves 41 and 42 are provided with an axial dimension sufficient that when the sleeves are joined, the sleeves provide a radial face opposing the free ends 37 and 36 of the stops 34 and 32 respectively. Thereby the stops also act to limit the axial displacement of the housing 21**.

The downstream sleeve 42 on its upper portion **42*a* is provided with an opening 50 therethrough which communicates with the interior of the tube 15 by means of an opening 51 made through the tubing to align with opening 50. The opening 50 is covered by a duct 52 which acts as an intake for a blower 53 mounted on the upper portion 42*a* and which is provided with an operating motor 54. The motor 54 and blower 53 are supported by a support platform 57 which is welded to the rigid support brace 47**.

In operation of the grain cleaning attachment 20 as attached to an auger 10 as described above, the auger shaft 13 is rotated with the helical flighting 14 drawing grain from the intake 12 through the auger tube 15 and to the auger discharge (not shown). The vibration motor 26 is energized which causes vibration of the housing 21 about the flighting 14. The clearance between the flighting 14 and the inner surface of the housing 21 accommodates the vibration as do the rubber sleeves 28 and 29. Also, stops 32 and 34 riding on the upper surface of the tube 15 prevent the housing 21 from falling onto the rotating flighting 14 and, by reason of opposing radial surfaces of the sleeves 41 and 42, the stops 32 and 34 limit axial movement of the housing 21.

As the grain is carried through the tube 15, the grain enters the housing 21 and it is vibrated and agitated by means of the vibration of the housing 21. Accordingly, the grain is passing over a vibrating screen 23. The size of the mesh of the screen 23 is selected to hinder passage through the screen of the desired grain and permit passage through the screen of smaller undesirable solid foreign particles. As the grain moves along the vibrating screen 23, the grain is cleaned of foreign debris except for debris which is so light that it migrates due to vibration to the top of the screen and cannot be passed through the screen 23.

As the grain proceeds out of the housing into the portion of the tube 15 enclosed by the sleeve 42, the light foreign material is at the top surface of the grain. The motor 54 of the blower 53 is operated with the blower generating a suction on the interior of the tube 15 in the area surrounded by sleeve 42. The suction draws off the air from the tube by creating a current through the tube toward the blower. The current draws the light material from the grain and carries it through the chute 52. The light material is discharged from the blower 53 to the atmosphere outside of the tube 15. Also, it is believed air flow from atmosphere through the screen 23 passes through the grain and picks up small material and carries it out the blower 53.

As has been shown, grain which has been passed through the auger 10 is cleaned by the attachment 20 through a two-stage process including passing the grain through a vibratory screen for cleansing the grain of heavier solid particles and next passing the partially cleansed grain through a suction treatment with the lighter foreign particles being removed. Additionally, the screen and the suction cleaning cooperate with one another since the vibratory screen acts to draw small light particles to the top of the grain to improve the efficiency of the suction cleansing. The grain cleansing attachment of the present invention can be used to cleanse a variety of grains. The screen portion 23 of the housing 21 can be replaced with one of several different screens having different sized mesh to account for the varying sizes of grains which may be cleaned by the cleaning attachment 20. Additionally, the screen 23 can be replaced with a solid semicylindrical portion or, alternatively, covered by a solid portion to permit use of an auger 10 equipped with the attachment 20 to be used solely for transporting grain without operating it as a cleansing apparatus. Finally, while the invention has been described as an apparatus to retrofit existing augers 10, it will be appreciated that an auger can be manufactured with features such as those described above as an integral part of the auger.

While the foregoing invention has been described in a preferred embodiment, it will be appreciated that there are other modifications and different embodiments which would be apparent to those skilled in the art and within the scope of the claims such as are appended hereto.

What is claimed is:

1. A grain cleansing attachment for a grain auger having an auger shaft with flighting secured for rotation about a shaft axis and an auger tube surrounding said flighting with a portion of said tube removed to expose a portion of said flighting;

means for rotating said auger shaft;

means for positioning said auger to draw grain from a source at an upstream end of said tube by rotating said auger shaft and flighting and transporting said grain through said tube and discharging said grain from a downstream end of said tube;

said cleaning attachment comprising a housing sized to surround said portion of said flighting, said housing having an inner surface opposing and spaced from said portion of said flighting, said inner surface being spaced apart from said portion of said flighting by a predetermined distance, said distance being sized to accommodate a vibratory stroke of said housing toward and away from said flighting without said housing interferring with operation of said flighting;

flexible means for fastening said housing to said tube with said housing free to vibrate relative to said tube; stop means acting on said auger tube for preventing an upper surface of said inner surface from contacting an upper portion of said portion of said flighting;

said housing having a sieve; and vibration means for vibrating said housing whereby grain transported through said auger is vibrated on top of said sieve with impurities mixed with said grain passing through said sieve thereby cleansing said grain as said grain moves through said housing.

2. A grain cleansing attachment according to claim 1 comprising suction means for drawing a suction on an interior of said tube and having a discharge exterior of said tube.

3. A grain cleansing attachment according to claim 2 wherein said suction means is provided on a side of said housing downstream from said housing whereby vibratory action of said housing causes small particulate matter within said tube to migrate to an upper surface of the grain and said airflow through the sieve carries small particulate matter out of said grain and out of said tube to further cleanse said grain passing through said tube.

4. A grain cleansing attachment according to claim 3 wherein said housing comprises an upper semicylindrical half and a lower semicylindrical half with means for joining said halves and wherein said lower half is said sieve.

5. A grain cleansing attachment according to claim 3 comprising support means for rigidly connecting a portion of said tube downstream said housing to a portion of said tube upstream said housing.

6. A grain cleansing attachment according to claim 5, said support means comprising a first rigid sleeve surrounding said tube on an upstream side of said housing and adjacent to said housing with said sleeve rigidly secured to said tube;

a second rigid sleeve surrounding said tube on a downstream side of said housing and adjacent said housing with said second sleeve rigidly secured to said tube;

rigid brace means for rigidly connecting said first and second sleeves.

7. A grain cleansing attachment according to claim 6 comprising an opening formed through an upper portion of said second sleeve in communication with an interior of said tube on a downstream side of said housing, said suction means being operatively connected to said opening to draw suction on said opening.

8. A grain auger having an auger shaft with flighting secured for rotation about a shaft axis and an auger tube surrounding said flight including a downstream portion, an upstream portion and an intermediate portion disposed between said downstream and upstream portions;

means for rotating said auger shaft;

means for positioning said auger to draw grain from a source at a first end on said upstream portion by rotating said auger shaft and flighting and transporting said grain through said tube and discharging said grain from a second end on said downstream portion;

said intermediate portion having a sieve and said intermediate portion having an inner surface opposing and spaced from said flighting, said inner surface being spaced apart from said flighting received with said intermediate portion by a predetermined distance said predetermined distance being sized to accommodate a vibratory stroke of said intermediate portion toward and from said flighting without said intermediate portion interfering with operation of said flighting;

means flexibly attaching said intermediate portion to said downstream and upstream portions with said intermediate portion free to vibrate relative to said downstream and upstream portion;

stop means acting on at least one of said upstream and downstream portions of said auger tube for preventing an upper surface of said inner surface from contacting an upper portion of said flighting received within said intermediate portion; and means for vibrating said intermediate portion whereby grain passing through said auger tube is vibrated within said intermediate portion with foreign particulates mixed with said grain passing through said sieve and said cleansed grain continuing to pass through said intermediate portion into said downstream portion.

9. A grain auger according to claim 8 comprising means for drawing a suction on an interior of said downstream portion adjacent said intermediate portion.

10. A grain auger according to claim 9 comprising support means for rigidly connecting said downstream portion with said upstream portion without interfering with vibratory motion of said intermediate portion.

11. A grain auger according to claim 10 wherein said stop means is secured to said intermediate portion and abutting said upstream portion and said downstream portion with said stop means limiting displacement of said intermediate portion to a displacement not greater than said predetermined distance between said flighting and said inner surface of said intermediate portion.

12. A grain cleansing attachment for a grain auger having an auger shaft with flighting secured for rotation about a shaft axis and having an auger tube surrounding said flighting with a portion of said tube removed to expose a portion of said flighting;

means for rotating said auger shaft;

means for positioning said auger to draw grain from a source at an upstream end of said tube by rotating said auger shaft and flighting and transporting said grain through said tube and discharging said grain from a downstream end of said tube;

said cleansing attachment comprising a housing sized to surround said exposed portion of said flighting and having a sieve;

flexible sleeves secured to ends of said housing and connecting said housing to free ends of said tube opposing free ends of said housing;

stop secured to an upper portion of said housing and having free ends extending beyond said exposed portion;

said housing having an interior surface surrounding said flighting, said interior surface being spaced from said flighting a clearance greater than a desired vibration stroke for said housing;

vibratory motor means secured to said housing for vibrating said housing said desired stroke;

support means comprising a first rigid sleeve rigidly secured to said tube adjacent said housing and downstream thereof and a second rigid sleeve rigidly secured to said tube adjacent said housing on an upstream side thereof; rigid brace means connecting said first sleeve with said second sleeve; and means for drawing a suction on an interior of said tube downstream of said housing.

13. A grain cleansing attachment according to claim 12 wherein said means for drawing a suction comprises an opening formed through said first sleeve and said tube in communication with said interior of said tube surrounded by said first sleeve and a blower having an intake in communication with said opening and a discharge exterior of said tube; and power actuated means for operating said blower to draw a suction through said opening.

* * * * *

UNITED STATES PATENT AND TRADEMARK OFFICE

CERTIFICATE OF CORRECTION

PATENT NO. : 4,684,458

DATED : August 4, 1987

INVENTOR(S) : LaVon P. Grotto

It is certified that error appears in the above-identified patent and that said Letters Patent is hereby corrected as shown below:

Column 7, line 7, "with" should be --within--; and

Column 7, line 8, a comma --,-- should be inserted before "said".

Signed and Sealed this

First Day of December, 1987

*Attest:*

*Attesting Officer*

DONALD J. QUIGG

*Commissioner of Patents and Trademarks*